US011116296B1

(12) United States Patent
Xie

(10) Patent No.: US 11,116,296 B1
(45) Date of Patent: Sep. 14, 2021

(54) OUTDOOR UMBRELLA WITH FREE AXIAL ROTATION MECHANISM

(71) Applicant: Yotrio Group Co., Ltd., Linhai (CN)

(72) Inventor: Jianqiang Xie, Linhai (CN)

(73) Assignee: Yotrio Group Co., Ltd., Zhejiang (CN)

( * ) Notice: Subject to any disclaimer, the term of this patent is extended or adjusted under 35 U.S.C. 154(b) by 0 days.

(21) Appl. No.: 16/888,854

(22) Filed: Jun. 1, 2020

(30) Foreign Application Priority Data

May 6, 2020 (CN) ..... 202010372283.8

(51) Int. Cl.
*A45B 17/00* (2006.01)
*A45B 25/00* (2006.01)
*A45B 23/00* (2006.01)

(52) U.S. Cl.
CPC ..... *A45B 25/00* (2013.01); *A45B 23/00* (2013.01); *A45B 17/00* (2013.01); *A45B 2017/005* (2013.01); *A45B 2023/0012* (2013.01)

(58) Field of Classification Search
CPC . A45B 23/00; A45B 2023/0012; A45B 25/00; A45B 2023/0075; A45B 2017/005
See application file for complete search history.

(56) References Cited

U.S. PATENT DOCUMENTS 6,575,182 B2 * 6/2003 Tung ..... A45B 17/00 135/20.1
6,575,183 B2 * 6/2003 Tung ..... A45B 17/00 135/20.3
7,412,985 B2 * 8/2008 Ma ..... A45B 17/00 135/20.1
9,615,637 B1 * 4/2017 Tung ..... A45B 25/14

FOREIGN PATENT DOCUMENTS

CN 2706656 Y 6/2005
WO WO-2006000136 A1 * 1/2006 ..... A45B 17/00

* cited by examiner

*Primary Examiner* — Noah Chandler Hawk
(74) *Attorney, Agent, or Firm* — James Cai; SAC Attorneys LLP

(57) ABSTRACT

An outdoor umbrella with a free axial rotation mechanism includes upper and lower umbrella columns, and a jiggle shell assembly positioned on the upper umbrella column. The jiggle shell assembly includes a jiggle shell and a jiggle mechanism. A travel cavity is formed at the bottom of the jiggle shell. An axial rotation mechanism is arranged on a lower part of the jiggle shell assembly mounting the upper and lower umbrella columns. When the axial rotation mechanism is in an unlocked state, upper umbrella column rotates freely along an axial direction. The axial rotation mechanism comprises a socket-and-spigot mechanism and a locking mechanism arranged outside the upper and lower umbrella columns. An upper end part of locking mechanism is positioned in travel cavity and its height is a travel range of realizing clutching of the locking mechanism; and the socket-and-spigot mechanism is positioned in upper and lower umbrella columns.

6 Claims, 12 Drawing Sheets

OUTDOOR UMBRELLA WITH FREE AXIAL ROTATION MECHANISM

CROSS-REFERENCE TO RELATED APPLICATIONS

This application claims priority to and the benefit of the non-provisional patent application titled "Outdoor Umbrella With Free Axial Rotation Mechanism", application number 202010372283.8, filed in the Chinese State Intellectual Property Office (SIPO) on May 6, 2020. The specification of the above referenced patent application is incorporated herein by reference in its entirety.

TECHNICAL FIELD

The invention relates to the technical field of an outdoor umbrella, in particular to an outdoor umbrella with a free axial rotation mechanism.

BACKGROUND

The outdoor umbrella, serving as an outdoor leisure appliance, is also known as a beach umbrella, a sun umbrella, a Roman umbrella, a middle column umbrella, a banana umbrella, etc., is widely applied to recreational places such as squares, sandy beaches, parks, courtyards, etc., and provides comfortable leisure and cool space for people.

However, with the change of a sunlight irradiation angle, the general sunshade outdoor umbrella can adjust the inclination angle of an umbrella fabric only by an inbuilt bending device, but cannot realize relative rotation of the umbrella fabric and the ground, resulting in relatively poor use performance and weak user experience.

Therefore, the Chinese patent with the publication number of CN2706656 discloses a rotating device capable of rotating an umbrella fabric, mainly comprising a bearing pedestal and a shaft sleeve which are fixed between two sections of umbrella tubes respectively, wherein a bearing is arranged in the bearing pedestal; a coupling shaft for connecting the bearing pedestal with the shaft sleeve passes through the bearing pedestal, the bearing and the shaft sleeve, and is fixed with the shaft sleeve into a whole body; the coupling shaft is in movable fit with the bearing pedestal and the bearing; a middle section lower tube and a rotary knob are connected detachably through a clutch mechanism; and a middle section upper tube and the rotary knob are connected synchronously and rotatably through a connecting mechanism. Meanwhile, US patent U.S. Ser. No. 11/063,234 also discloses the above structure. However, the structure has the defects that the rotating device is tedious in structure, inconvenient in assembling and high in cost, and has the problems that the rotary knob will be jammed when the clutching mechanism is slightly deformed and the rotary knob cannot be separated from the clutch ring; in addition, operation of the rotary knob is relatively inconvenient.

Therefore, our applicant has newly designed an outdoor umbrella capable of rotating freely in an axial direction, which abandons a bearing pedestal, a bearing, etc., simplifies an internal structure, can realize rapid locking clutch and greatly improves convenience of rotating operation.

SUMMARY OF THE INVENTION

The invention aims to provide an outdoor umbrella with a free axial rotation mechanism, which is used for solving the above technical problems, reducing production cost and improving convenience of operation.

The technical problems to be solved by the invention are solved by the following technical schemes: an outdoor umbrella with a free axial rotation mechanism, comprising an upper umbrella column, a lower umbrella column and a jiggle shell assembly which is positioned on the upper umbrella column, wherein an umbrella fabric is arranged on an upper part of the upper umbrella column. The jiggle shell assembly comprises a jiggle shell and a jiggle mechanism. A travel cavity is formed at the bottom of the jiggle shell. An axial rotation mechanism is arranged on a lower part of the jiggle shell assembly and is used for undertaking mounting of the upper umbrella column and the lower umbrella column. When the axial rotation mechanism is in an unlocked state, the upper umbrella column may rotate freely along an axial direction. In an embodiment, the upper umbrella column rotates freely along an axial direction when the axial rotation mechanism is in an unlocked state. The axial rotation mechanism comprises a locking mechanism and a socket-and-spigot mechanism. The locking mechanism is arranged outside the upper and lower umbrella columns. An upper end part of the locking mechanism is positioned in the travel cavity and a height of the travel cavity is a travel range of realizing clutching of the locking mechanism; and the socket-and-spigot mechanism is positioned in the upper and lower umbrella columns.

The locking mechanism comprises a handle sleeve, an upper spring seat, a lower spring seat and a reset spring which is positioned between the upper spring seat and the lower spring seat. A first locking gear ring is arranged on an inner cavity wall of the handle sleeve. A second locking gear ring is arranged on a lower part of the lower spring seat; and the first locking gear ring and the second locking gear ring may realize engagement cooperation. In an embodiment, the first locking gear ring and the second locking gear ring realize engagement cooperation.

An upper end of the handle sleeve is positioned in the travel cavity; a check ring is arranged at the upper end of the handle sleeve; and the check ring moves in the travel cavity.

The outdoor umbrella with the free axial rotation mechanism further comprises a guide ring, wherein the guide ring and the lower umbrella column are fixedly arranged, and the handle sleeve moves up and down along the guide ring.

A guide groove is formed in a lower part of an inner cavity of the handle sleeve. A guide tooth is arranged on the guide ring; and the guide groove is used for being correspondingly matched with the guide tooth.

The upper spring seat, the lower spring seat, the reset spring and the guide ring are positioned in the inner cavity of the handle sleeve.

The socket-and-spigot mechanism comprises a center shaft and a sliding sleeve assembly, wherein the center shaft and the lower umbrella column are fixedly arranged. The sliding sleeve assembly and the upper umbrella column are fixedly arranged; and the sliding sleeve assembly may rotate axially along the center shaft. In an embodiment, the sliding sleeve assembly rotates axially along the center shaft.

The sliding sleeve assembly comprises an upper sliding ring, a lower sliding ring and a shaft sleeve, wherein the shaft sleeve is positioned between the upper sliding ring and the lower sliding ring. A washer is arranged at the upper end of the center shaft; and the washer is used for limiting the upper sliding ring.

A gap is formed between the shaft sleeve and the center shaft; and sliding ring mounting grooves are formed at the upper end and the lower end of the shaft sleeve.

Surfaces of the upper sliding ring and the lower sliding ring are smooth surfaces, and the upper and the lower sliding rings may rotate and slide along the center shaft. In an embodiment, the upper and the lower sliding rings are configured to rotate and slide along the center shaft.

Compared with the prior art, the outdoor umbrella with the free axial rotation mechanism has the following prominent advantages and effects: Through optimized design, locking clutch is realized by the locking mechanism; and through combination with the socket-and-spigot mechanism, the upper umbrella column rotates freely relative to the axial direction of the lower umbrella column, simplifying the internal structure and reducing the production costs and improving the convenience of rotating operation.

In order to clearly know the characteristics of the invention, refer to the drawings and the detailed description of the following good implementation manners.

DETAILED DESCRIPTION OF THE INVENTION

Figure 1:
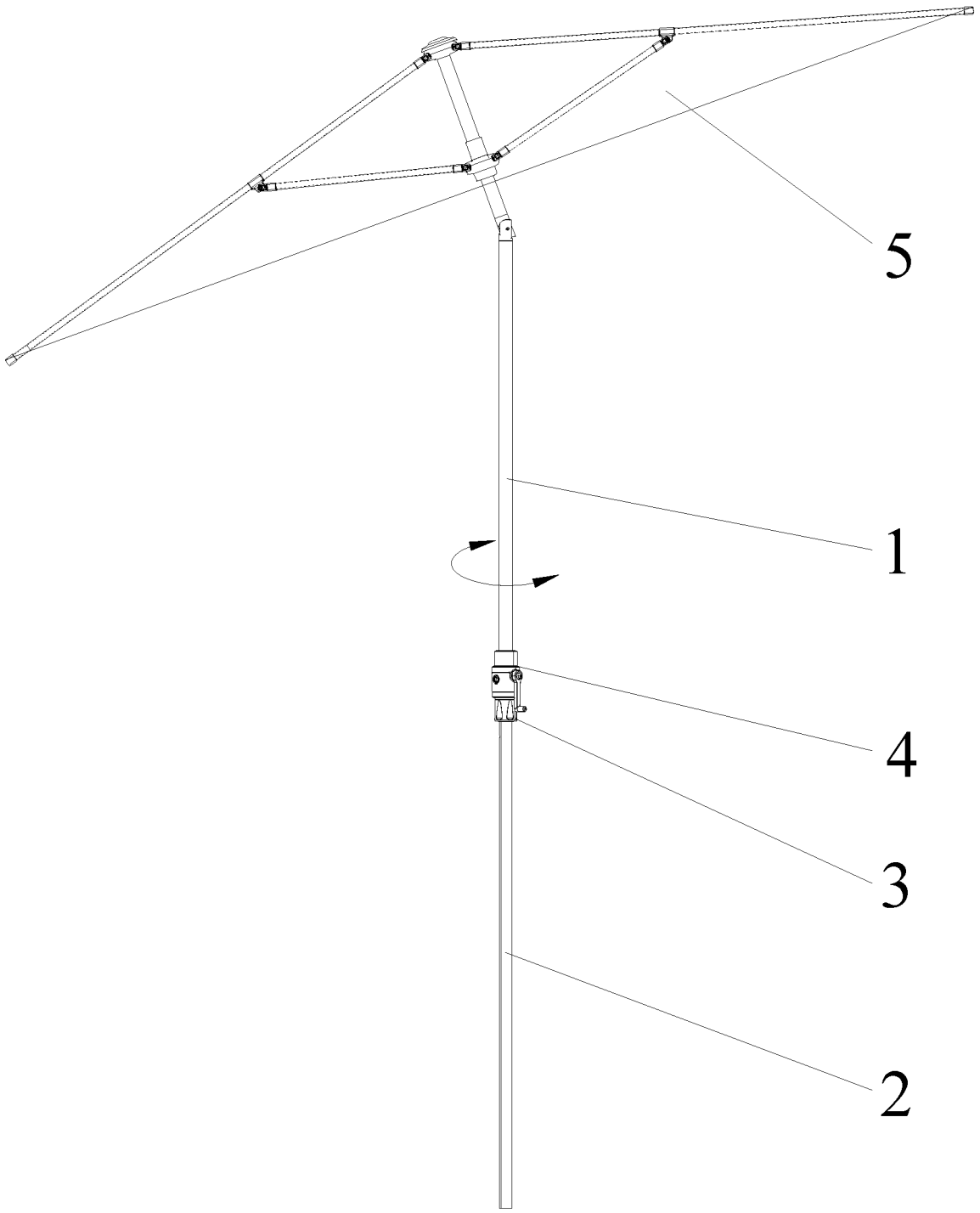
FIG. 1 is the structural diagram of the invention.
Figure 2:
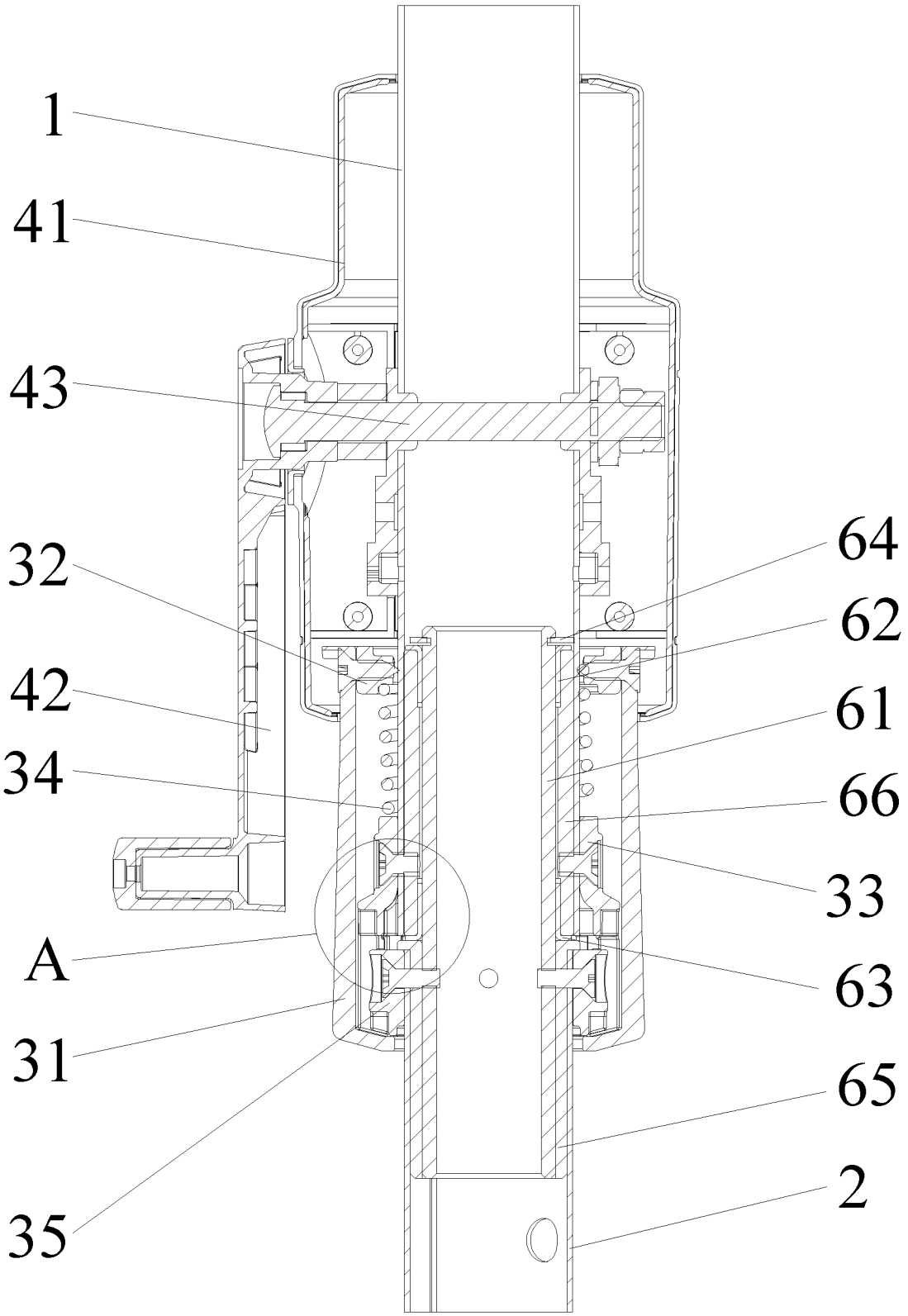
FIG. 2 is a sectional structure schematic diagram of the invention in an unlocked state.
Figure 3:
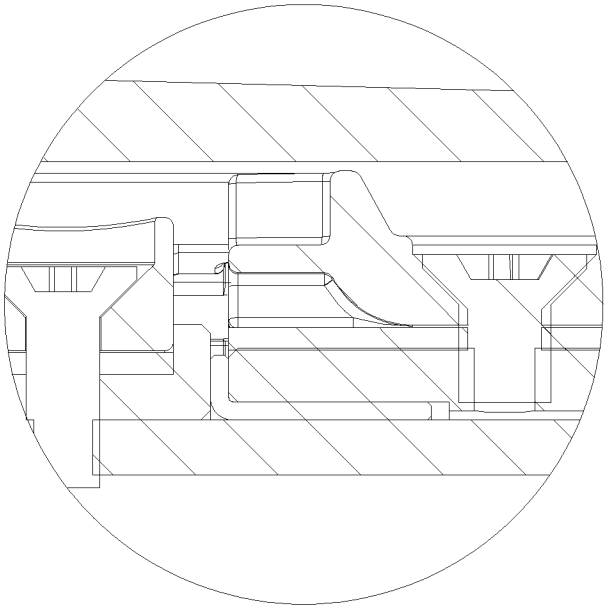
FIG. 3 is the partially enlarged schematic diagram of Part A in the FIG. 2.
Figure 4:
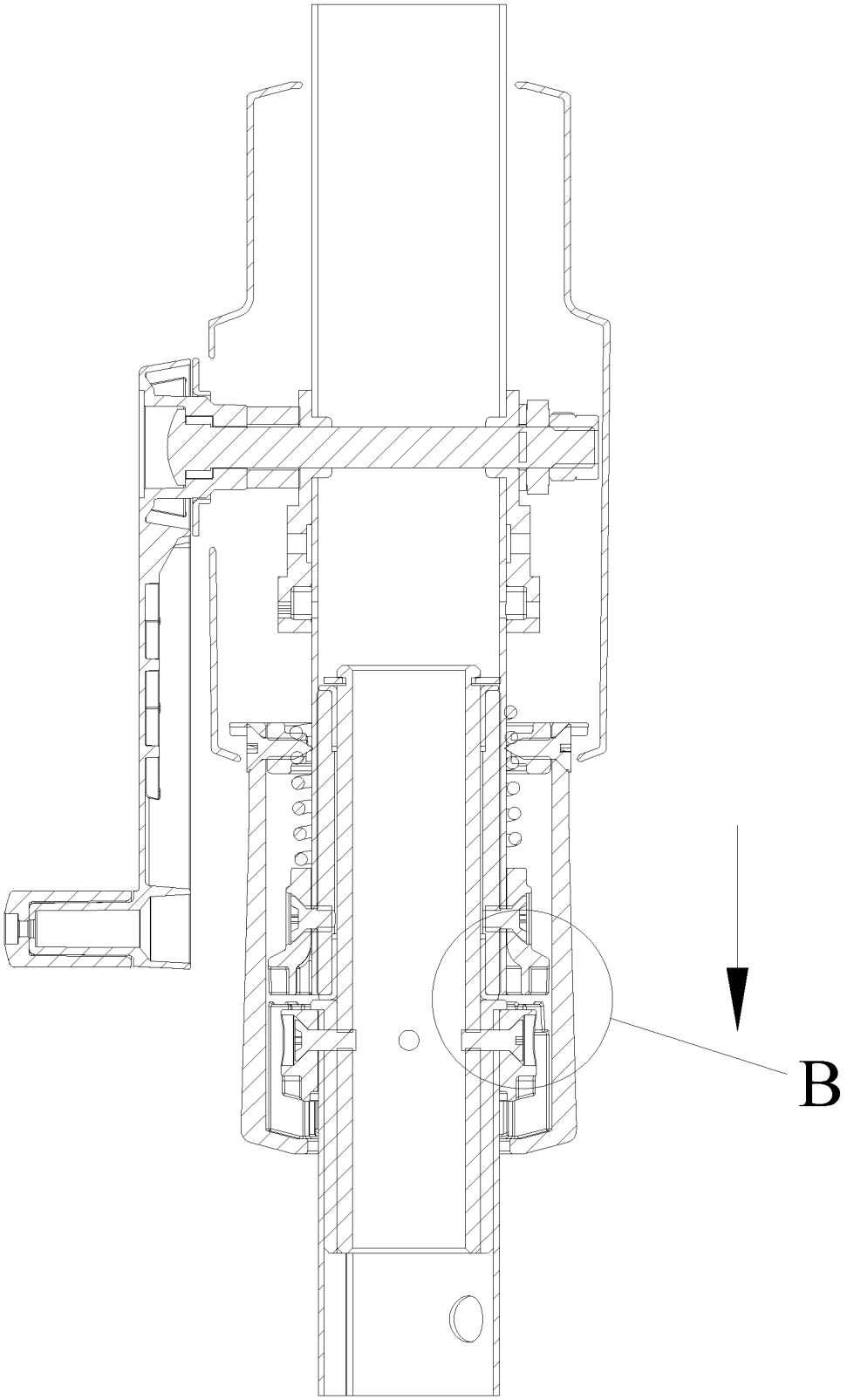
FIG. 4 is a sectional structure schematic diagram of the invention in a locked state.
Figure 5:
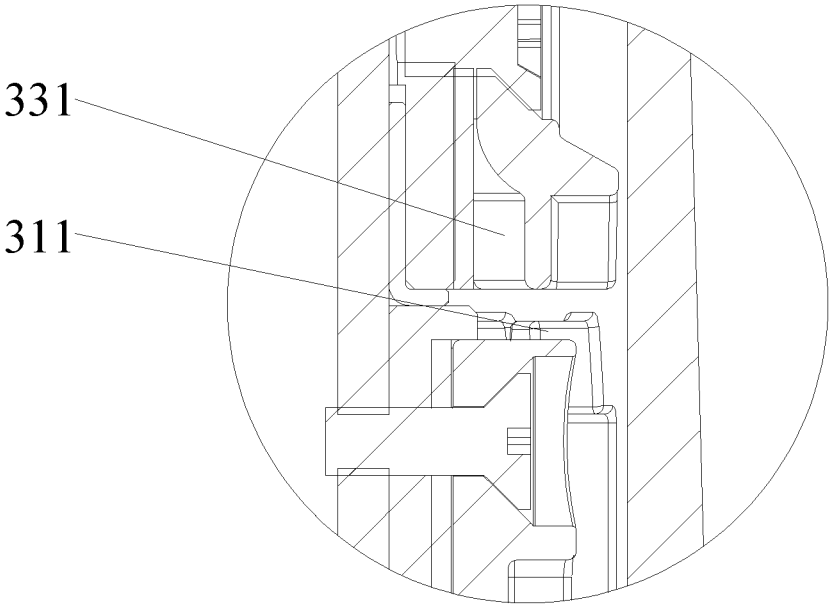
FIG. 5 is the partially enlarged schematic diagram of Part B in the FIG. 4.
Figure 6:
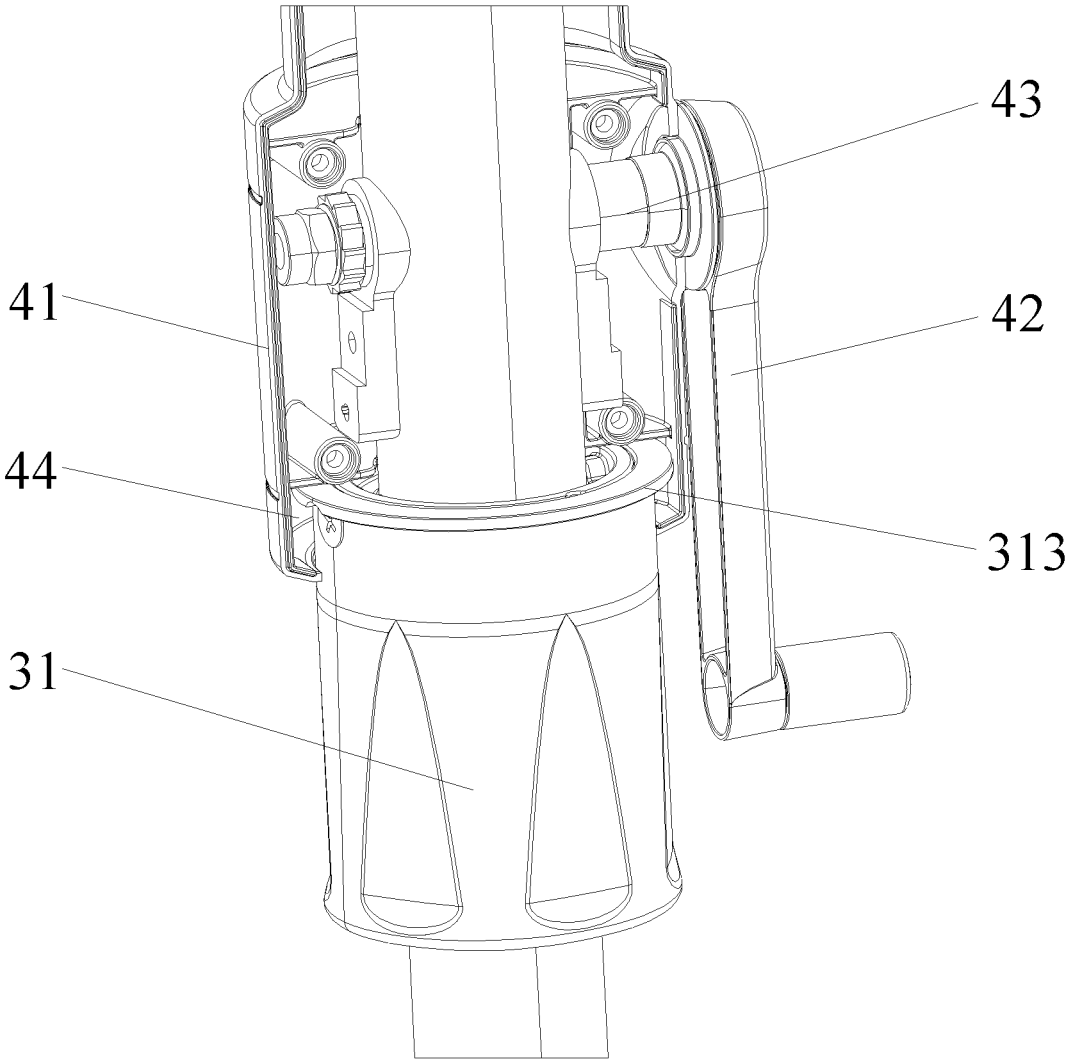
FIG. 6 is the internal structural schematic diagram I of the invention.
Figure 7:
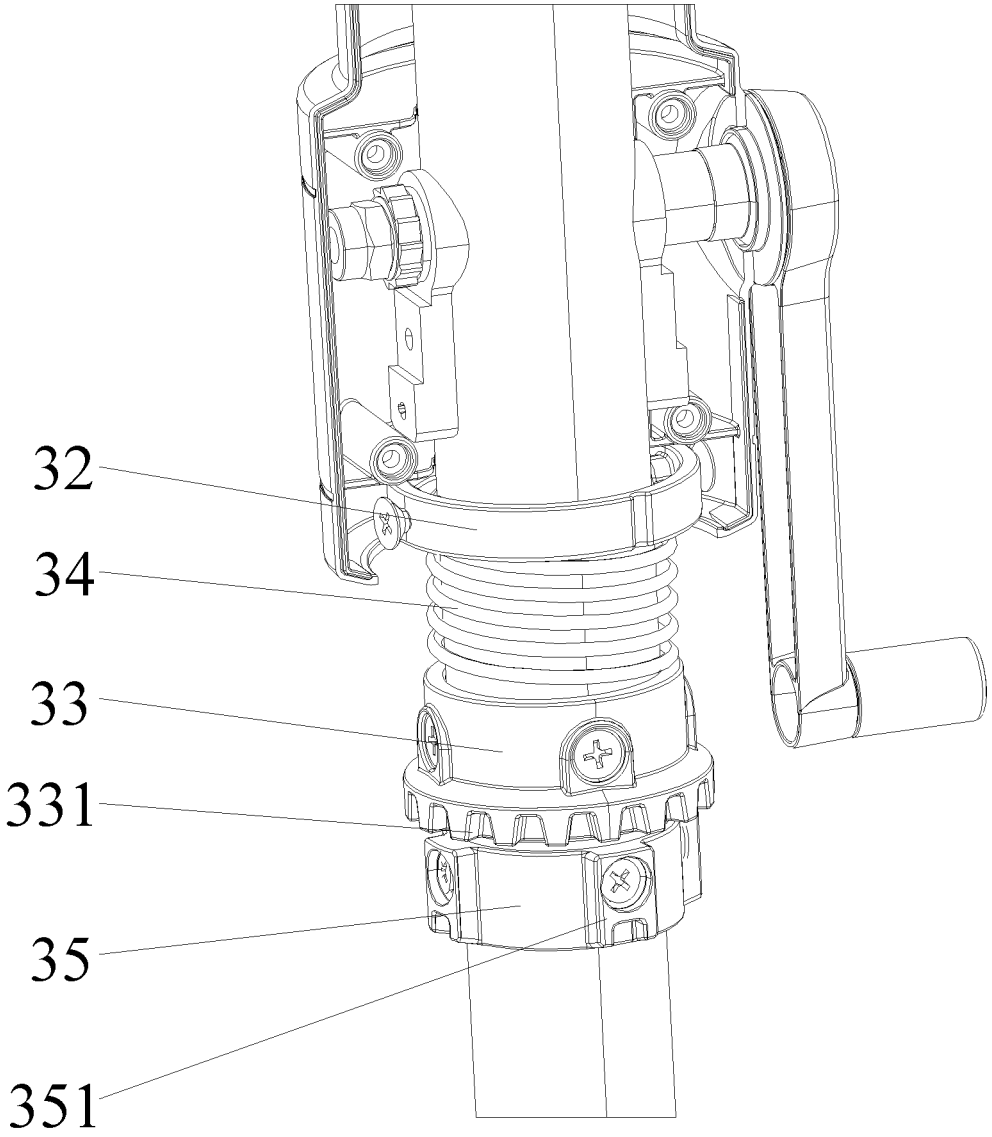
FIG. 7 is the structural schematic diagram II of the invention.
Figure 8:
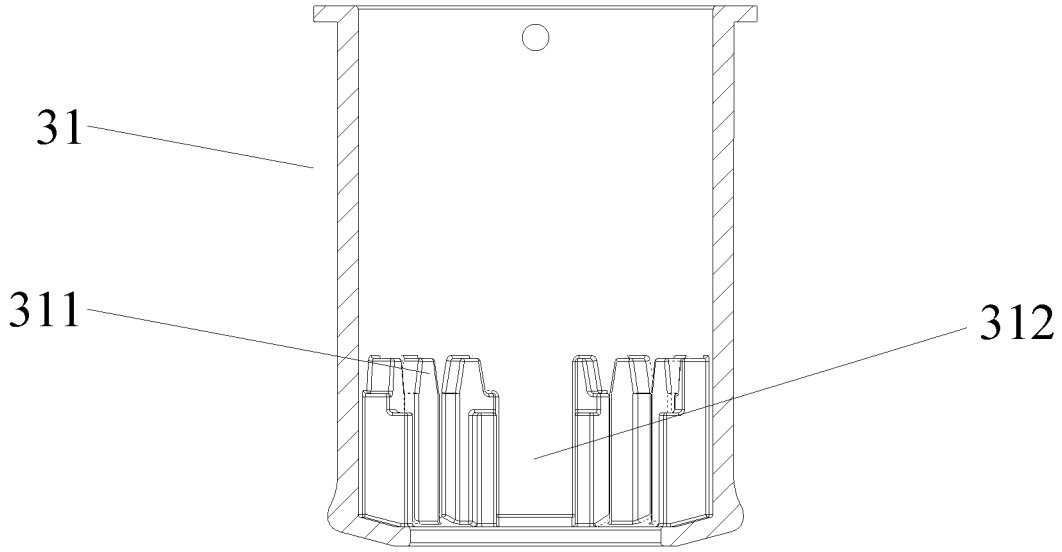
FIG. 8 is a structural schematic diagram I of a handle sleeve according to the invention.
Figure 9:
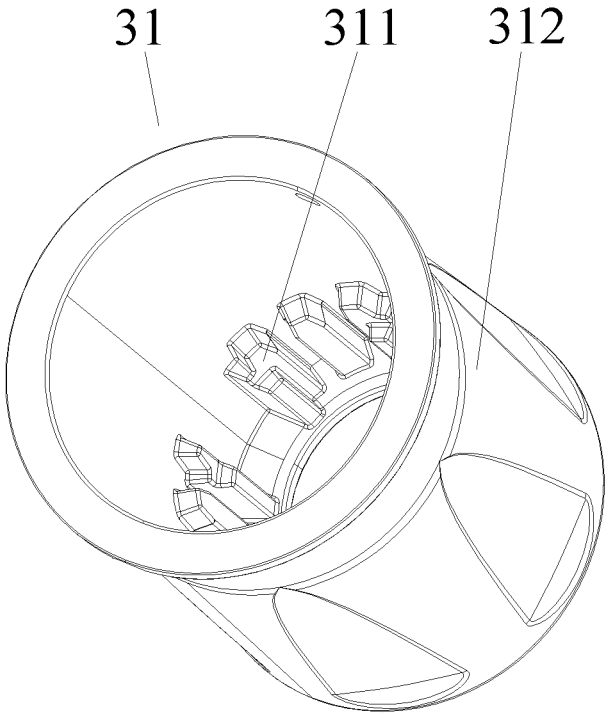
FIG. 9 is a structural schematic diagram II of a handle sleeve according to the invention.
Figure 10:
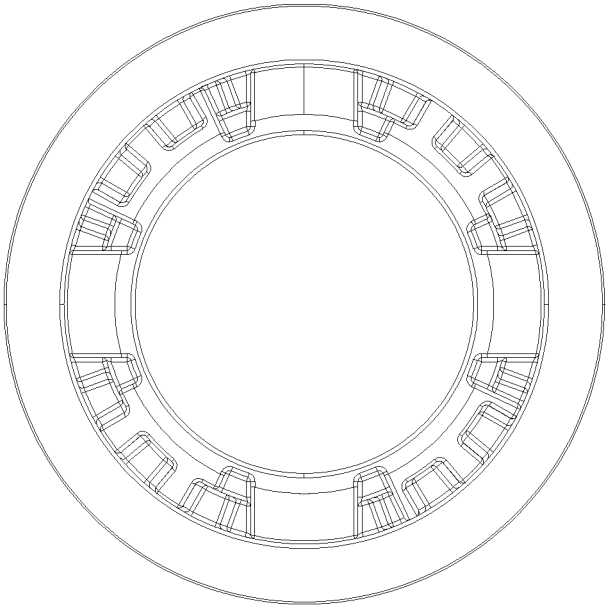
FIG. 10 is a structural schematic diagram III of a handle sleeve according to the invention.
Figure 11:
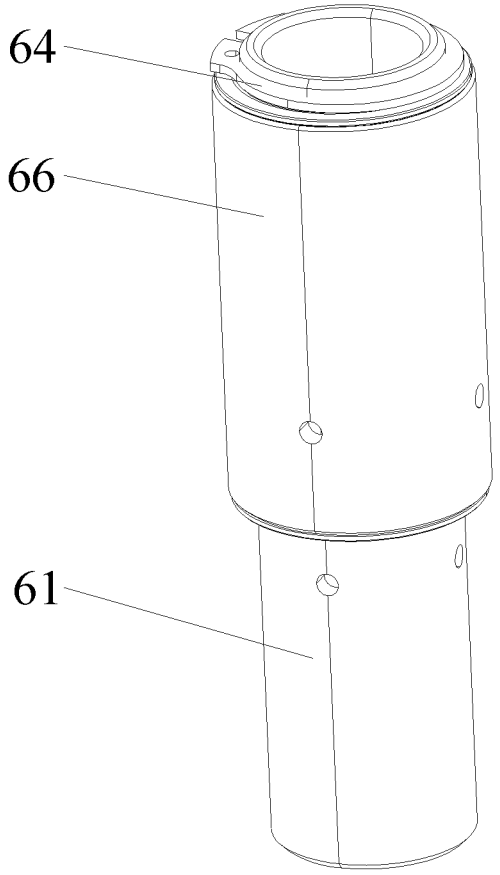
FIG. 11 is the structural schematic diagram I of a socket-and-spigot mechanism according to the invention.
Figure 12:
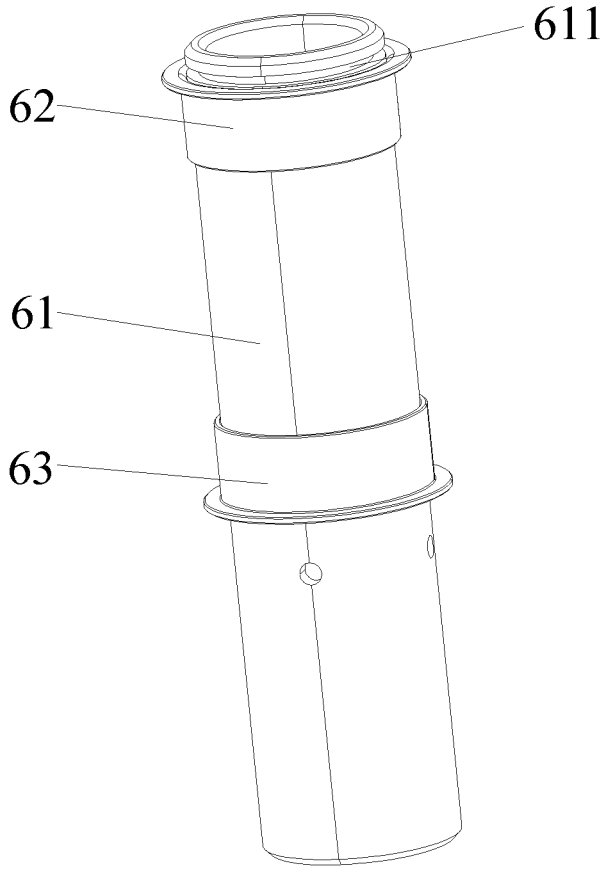
FIG. 12 is the structural schematic diagram II of a socket-and-spigot mechanism according to the invention.
Figure 13:
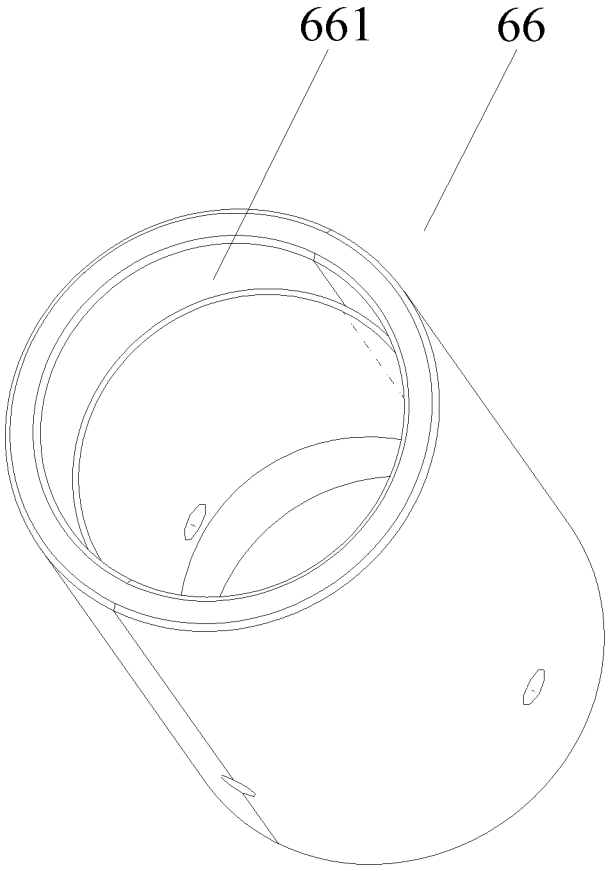
FIG. 13 is the shaft sleeve structural diagram of the invention.

In order to make the technological means, the creative characteristic, the achieved purpose and effect of this invention easily understood, this invention will be further explained according to specific illustration.

As shown in the accompanying drawings, an outdoor umbrella with a free axial rotation mechanism, provided by the embodiment, comprises an upper umbrella column 1, a lower umbrella column 2 and a jiggle shell assembly 4 which is positioned on the upper umbrella column 1, wherein an axial rotation mechanism 3 is arranged on a lower part of the jiggle shell assembly 4. The axial rotation mechanism is used for undertaking mounting of the upper umbrella column 1 and the lower umbrella column 2; when the axial rotation mechanism 3 is in an unlocked state, the upper umbrella column may rotate freely along an axial direction; and generally, the upper umbrella column 1 may realize 360° unintermittent double-way rotation, so that angle rotation of the umbrella fabric 5 on an upper part of the upper umbrella column 1 is realized conveniently. In an embodiment, when the axial rotation mechanism 3 is in an unlocked state, the upper umbrella column rotates freely along an axial direction; and generally, the upper umbrella column 1 realizes 360° unintermittent double-way rotation.

The axial rotation mechanism 3 comprises a locking mechanism and a socket-and-spigot mechanism, wherein the locking mechanism is arranged outside the upper umbrella column 1 and the lower umbrella column 2. An upper end part of the locking mechanism is positioned in a travel cavity 44. A height of the travel cavity 44 is a travel range of realizing clutching of the locking mechanism. The locking mechanism is used for realizing locking clutch; and the socket-and-spigot mechanism is arranged in the upper umbrella column 1 and the lower umbrella column 2, and realizes free axial rotation of the upper umbrella column 1 relative to the lower umbrella column 2.

The locking mechanism comprise a handle sleeve 31, an upper spring seat 32, a lower spring seat 33 and a reset spring 34 which is positioned between the upper spring seat 32 and the lower spring seat 33.

Preferably, the handle sleeve 31 and the upper spring seat 32 are fastened through a screw. The upper spring seat 32 is positioned at a position of an upper end part of an inner cavity of the handle sleeve 31, but not limited to the position. The upper spring seat 32 may further be positioned at a position of a middle upper part of the inner cavity of the handle sleeve 31, so that the reset spring 34 has an elastic reset travel, wherein the upper spring seat 32 is in in clearance fit with the upper umbrella column 1, and the upper spring seat 32 may move relative to the upper umbrella column 1. In an embodiment, the upper spring seat 32 is configured to be further positioned at a position of the middle upper part of the inner cavity of the handle sleeve 31, so that the reset spring 34 has an elastic reset travel.

Preferably, a first locking gear ring 311 is arranged on an inner cavity wall of the handle sleeve 31 The first locking gear ring 311 is positioned on an upper part of a guide groove 312. A preferable position of an engagement surface of the first locking gear ring 311 is a middle lower part position of the inner cavity wall of the handle sleeve 31. The lower spring seat 33 is fixed on a lower end part of the upper umbrella column 1 generally and preferably; a second locking gear ring 331 is arranged on a lower part of the lower spring seat 33; and the first locking gear ring 311 and the second locking gear ring 331 may realize engagement cooperation, wherein a preferable engagement position of the first locking gear ring 311 and the second locking gear ring 331 is a butt-joint position of the upper umbrella column 1 and the lower umbrella column 2. In an embodiment, the first locking gear ring 311 and the second locking gear ring 331 realize engagement cooperation.

In the above structure, when a user applies a downward force to the handle sleeve 31, the handle sleeve 31 moves integrally downwards to drive the upper spring seat 32 to move downwards relative to the upper umbrella column 1 to complete compression of the reset spring 34; meanwhile, an engagement surface of the first locking gear ring 311 is separated from an engagement surface of the second locking gear ring 331 to complete separation of the first locking gear ring 311 and the second locking gear ring 331, so that unlocking of the locking mechanism is completed.

A check ring 313 is arranged at an upper end of the handle sleeve 31 and extends outwards. A travel cavity 44 is formed at the bottom of the jiggle shell 41. A through hole is formed at the bottom of the travel cavity 44. The upper end of the handle sleeve 31 extends into the travel cavity 44 through the through hole; and an outer diameter size of the check ring 313 is greater than an inner diameter size of the through hole, so that when the handle sleeve 31 moves downwards to unlock, the movable limitation effect of the check ring 313 is achieved.

The outdoor umbrella with the free axial rotation mechanism further comprises a guide ring 35, wherein the guide ring 35 and the lower umbrella column 2 are fixedly arranged. The handle sleeve 31 moves up and down along the guide ring 35. A guide groove 312 is formed in a lower part of the inner cavity of the handle sleeve 31. A guide tooth 351 is arranged on the guide ring 35. The guide groove is used for being correspondingly matched with the guide tooth 351. The guide ring 35 is preferably positioned at an upper end position of the lower umbrella column 2 and an outer side is fixed in a sleeving way; and through the guide ring 35, the handle sleeve 31 may move downwards or reset smoothly, so that a guide effect is achieved. In an embodiment, the handle sleeve 31 moves downwards or resets smoothly through the guide ring 35.

The upper spring seat 32, the lower spring seat 33, the reset spring 34 and the guide ring 35 are positioned in the inner cavity of the handle sleeve 31, so the handle sleeve 31 forms a shell protective effect.

The jiggle shell assembly 4 further comprises a jiggle mechanism, wherein the jiggle mechanism comprises a jiggle bar 42 and a jiggle shaft 43; and an umbrella rope is arranged on the jiggle shaft 43 in a matched way, so that shrinking or opening of the umbrella fabric 5 is facilitated.

The socket-and-spigot mechanism comprises a center shaft 61 and a sliding sleeve assembly, wherein the center shaft 61 and the lower umbrella column 2 are fixedly arranged. The center shaft 61 is partially positioned in the lower umbrella column 2. The center shaft 61 and the lower umbrella column 2 are fastened through a screw; and generally, the screw runs through the guide ring 35, the lower umbrella column 2, a neck bush 65 and the center shaft 61 to complete integral fixation of a plurality of parts.

The sliding sleeve assembly and the upper umbrella column 1 are fixedly arranged, and the sliding sleeve assembly may rotate axially along the center shaft 61. In an embodiment, the sliding sleeve assembly rotates axially along the center shaft 61. The sliding sleeve assembly comprises an upper sliding ring 62, a lower sliding ring 63 and a shaft sleeve 66, wherein the shaft sleeve 66 is positioned between the upper sliding ring and the lower sliding ring 63. A gap is formed between the shaft sleeve 66 and the center shaft 61. The shaft sleeve 66 rotates relative to the center shaft 61. Generally, the upper umbrella column 1 and the shaft sleeve 66 are fastened through a screw; sliding ring mounting grooves 661 are formed at the upper end and the lower end of the shaft sleeve 66; and the upper sliding ring 62 and the lower sliding ring 63 are arranged in the sliding ring mounting grooves 661 correspondingly. In one embodiment, the upper sliding ring 62 and the lower sliding ring 63 are fastened and matched with the shaft sleeve 66, and rotation with the shaft sleeve 66 is synchronous rotation. In one embodiment, the upper sliding ring 62 and the lower sliding ring 63 are slidable and matched with the shaft sleeve 66, and rotation with the shaft sleeve 66 is synchronous or nonsynchronous rotation.

A washer 64 is arranged at the upper end of the center shaft 61. Generally, a clamping ring groove 611 is formed in an upper part of the center shaft 61 and is used for mounting the washer 64 in a matched way. The washer 64 covers an upper part of the upper sliding ring 62, so that the upper sliding ring 62 is limited. A bottom end of the lower sliding ring 63 is used for abutting against an upper end face of the neck bush 65. The neck bush 65 is arranged on an upper end part of the lower umbrella column 2 in a sleeving way, so that rotation flexibility is improved; and sectional structures of the upper sliding ring 62 and the lower sliding ring 63 are L-shaped.

Surfaces of the upper sliding ring 62 and the lower sliding ring 63 are smooth surfaces, and the upper sliding ring 62 and the lower sliding ring 63 may rotate and slide along the center shaft 61, so that rotation flexibility is improved. In an embodiment, the upper 62 and the lower sliding rings 63 are configured to rotate and slide along the center shaft 61.

According to the above, after a user completes unlocking of the locking mechanism, the user holds the upper umbrella column 1 to apply an axial rotation force, and the upper umbrella column 1 and the shaft sleeve 66 may complete rotation relative to the center shaft 61 and the lower umbrella column 2 through slidable structures of the upper sliding ring 62 and the lower sliding ring 63 relative to the center shaft 61, so that a position of the umbrella fabric 5 on the upper part of the upper umbrella column lis adjusted. In an embodiment, the upper umbrella column 1 and the shaft sleeve 66 complete the rotation relative to the center shaft 61 and the lower umbrella column 2 through slidable structures of the upper sliding ring 62 and the lower sliding ring 63 relative to the center shaft 61.

Through optimized design, locking clutch is realized by the locking mechanism; and through combination with the socket-and-spigot mechanism, the upper umbrella column rotates freely relative to the axial direction of the lower umbrella column, simplifying the internal structure and reducing the production costs and then greatly improving the convenience of rotating operation.

According to the technical knowledge, the invention may be implemented through other embodiments without departing from the spirit or necessary characteristics of the invention. Therefore, the above disclosed embodiments are, in all aspects, only illustrative and not exclusive. All changes within in the scope of the invention or equivalently within the scope of the invention are included by the invention.

I claim:

1. An outdoor umbrella with a free axial rotation mechanism, comprising:

an upper umbrella column, a lower umbrella column, and a jiggle shell assembly positioned on the upper umbrella column, wherein an umbrella fabric is arranged on an upper part of the upper umbrella column;

the jiggle shell assembly, comprising a jiggle shell, a jiggle mechanism, and a travel cavity formed at the bottom of the jiggle shell;

an axial rotation mechanism arranged on a lower part of the jiggle shell assembly, wherein the axial rotation mechanism is configured for mounting the upper umbrella column and the lower umbrella column, wherein the upper umbrella column rotates freely along an axial direction when the axial rotation mechanism is in an unlocked state;

the axial rotation mechanism comprising a locking mechanism and a socket-and-spigot mechanism, wherein the locking mechanism is arranged outside the upper umbrella column and the lower umbrella column, wherein an upper end part of the locking mechanism is positioned in the travel cavity, wherein a height of the travel cavity is a travel range for realizing clutching of the locking mechanism, and wherein the socket-and-spigot mechanism is positioned in the upper umbrella column and the lower umbrella column, wherein the locking mechanism comprises a handle sleeve, an upper spring seat, a lower spring seat, and a reset spring positioned between the upper spring seat and the lower spring seat, wherein a first locking gear ring is arranged on an inner cavity wall of the handle sleeve, wherein a second locking gear ring is arranged on a lower part of the lower spring seat, and wherein the first locking gear ring and the second locking gear ring realize engagement cooperation;

a guide ring, wherein the guide ring and the lower umbrella column are fixedly arranged, and the handle sleeve moves up and down along the guide ring; and a guide groove formed in a lower part of an inner cavity of the handle sleeve, wherein a guide tooth is arranged on the guide ring and the guide groove is used for being correspondingly matched with the guide tooth.

2. The outdoor umbrella with the free axial rotation mechanism of claim 1, wherein an upper end of the handle sleeve is positioned in the travel cavity, wherein a check ring is arranged at the upper end of the handle sleeve, and wherein the check ring moves in the travel cavity.

3. The outdoor umbrella with the free axial rotation mechanism of claim 1, wherein the upper spring seat, the lower spring seat, the reset spring and the guide ring are positioned in the inner cavity of the handle sleeve.

4. An outdoor umbrella with a free axial rotation mechanism, comprising:

an upper umbrella column, a lower umbrella column, and a jiggle shell assembly positioned on the upper umbrella column, wherein an umbrella fabric is arranged on an upper part of the upper umbrella column;

the jiggle shell assembly, comprising a jiggle shell, a jiggle mechanism, and a travel cavity formed at the bottom of the jiggle shell;

an axial rotation mechanism arranged on a lower part of the jiggle shell assembly, wherein the axial rotation mechanism is configured for mounting the upper umbrella column and the lower umbrella column, wherein the upper umbrella column rotates freely along an axial direction when the axial rotation mechanism is in an unlocked state; and the axial rotation mechanism comprises a locking mechanism and a socket-and-spigot mechanism, wherein the locking mechanism is arranged outside the upper umbrella column and the lower umbrella column, wherein an upper end part of the locking mechanism is positioned in the travel cavity, wherein a height of the travel cavity is a travel range of realizing clutching of the locking mechanism, wherein the socket-and-spigot mechanism is positioned in the upper umbrella column and the lower umbrella column, and wherein the socket-and-spigot mechanism comprises a center shaft and a sliding sleeve assembly, wherein the center shaft and the lower umbrella column are fixedly arranged, wherein the sliding sleeve assembly and the upper umbrella column are fixedly arranged, wherein the sliding sleeve assembly is configured to rotate axially along the center shaft, wherein the sliding sleeve assembly comprises an upper sliding ring, a lower sliding ring and a shaft sleeve, wherein the shaft sleeve is positioned between the upper sliding ring and the lower sliding ring, and wherein a washer is arranged at an upper end of a center shaft, and wherein the washer is used for limiting the upper sliding ring.

5. The outdoor umbrella with the free axial rotation mechanism of claim 4, wherein a gap is formed between the shaft sleeve and the center shaft, and wherein sliding ring mounting grooves are formed at an upper end and a lower end of the shaft sleeve.

6. The outdoor umbrella with the free axial rotation mechanism of claim 4, wherein surfaces of the upper sliding ring and the lower sliding ring are smooth surfaces, and wherein the upper sliding ring and the lower sliding ring are configured to rotate and slide along the center shaft.

* * * * *